US005957456A

United States Patent [19]

Tullos

[11] Patent Number: 5,957,456

[45] Date of Patent: Sep. 28, 1999

[54] BINGO SHEET STACKING APPARATUS

[76] Inventor: Melvin Tullos, 13521 Force, Houston, Tex. 77015

[21] Appl. No.: 08/901,642

[22] Filed: Jul. 28, 1997

[51] Int. Cl.[6] ..... A63F 3/06

[52] U.S. Cl. ..... 273/269; 273/309; 211/50

[58] Field of Search ..... 273/269, 148 R, 273/153 R, 309, 148 A; 40/124.09, 661, 124.16, 733, 787, 904; 211/42, 43, 50

[56] References Cited

U.S. PATENT DOCUMENTS

| | | | |
|---|---|---|---|
| 1,508,020 | 9/1924 | Horwitt | 273/148 A |
| 2,461,536 | 3/1949 | Farkas | 40/661 |
| 2,872,215 | 2/1959 | Taylor | 273/309 |
| 5,007,192 | 4/1991 | Hochberg | 40/661 |
| 5,213,326 | 5/1993 | Rundell et al. | 273/269 |
| 5,732,978 | 3/1998 | Tunnell | 40/904 |

*Primary Examiner*—William M. Pierce
*Attorney, Agent, or Firm*—Harrison & Egbert

[57] ABSTRACT

A bingo sheet stacking apparatus having a first panel, a second panel hingedly connected to the first panel, and a multi-sectional support panel hingedly connected to the first panel. The multi-sectional support panel is configurable between a first planar configuration and a second configuration of a generally triangular cross-section. The second panel has a fastener member affixed to a surface thereof opposite the first panel. The support panel has a fastener attached thereto. The fastener of the second panel is engagable with the fastener of the support panel so as to retain the support panel in the second configuration.

18 Claims, 4 Drawing Sheets

BINGO SHEET STACKING APPARATUS

TECHNICAL FIELD

The present invention relates to devices for displaying bingo sheets in a convenient manner. More particularly, the present invention relates to devices for stacking bingo sheets for sequentially accessing each of the bingo sheets. More particularly, the present invention relates to bingo sheet stacking apparatus that include convenient carrying techniques.

BACKGROUND ART

In the game of bingo, it is often desirable to play a large number of bingo sheets. Each of the bingo sheets includes a plurality of bingo cards that are displayed on a single sheet. In normal practice, the bingo player would like to play a large number of sheets so as to maximize his or her ability to win the bingo game. In many circumstances, there are discounts for playing a large number of bingo sheets simultaneously.

In a game of bingo, when a number is called, it is important to be able to check each of the cards on each of the bingo sheets so as to determine whether the number on the card matches the number on the card matches the number that was called. Bingo players must quickly scan each of the cards on each of the sheets so as to determine whether the number matches. Under certain circumstances, it is often difficult for bingo players to scan the large number of cards during the time period between number calls. As such, a need has developed so as to conveniently allow the bingo player to organize multiple sheets for easy access.

In the past, bingo players have often played multiple sheets by stacking the sheets one on top of another. This is very difficult since the bingo player must lift each sheet from on top of the underlying sheet before the underlying sheet can be scanned. It often becomes difficult to quickly and easily separate the sheets. Furthermore, when a bingo player uses a "dobber" for the marking of the bingo sheets, the ink from the dobber may soak onto the underlying sheet so as to create confusing results. Under other circumstances, the bingo player may spread the bingo sheets over a wide area in the bingo hall. This can take up a great deal of room within the bingo hall and may be unacceptable. In this sort of arrangement, the bingo player must traverse relatively large distances so as to conveniently scan each of the cards on the many bingo sheets.

It is an object of the present invention to provide a bingo sheet stacking device which allows the bingo player to easily scan each of the bingo sheets.

It is another object of the present invention to provide a bingo sheet stacking device that is easy to use.

It is another object of the present invention to provide a bingo sheet stacking device which retains each of the bingo sheets in a proper position for viewing.

It is another object of the present invention to provide a bingo sheet stacking device that can be conveniently stored, transported, and set up.

It is a further object of the present invention to provide a bingo sheet stacking device that is relatively inexpensive and easy to manufacture.

These and other objects and advantages of the present invention will become apparent from a reading of the attached specification and appended claims.

SUMMARY OF THE INVENTION

The present invention is a bingo sheet stacking apparatus that comprises a first panel, a second panel hingedly connected to the first panel, and a multi-sectional support panel hingedly connected to the first panel. The multi-sectional support panel is configurable between a first planar configuration and a second configuration of a generally triangular cross-section. The second panel has a fastener member affixed to a surface thereof opposite the first panel. The support panel has a fastener attached thereto. The fastener of the second panel is engagable with the fastener of the support panel so as to retain the support panel in the second configuration. The fastener of the second panel is positioned adjacent to the hinged connection with the first panel. The fastener of the support panel is positioned at an end of the support panel opposite the hinged connection with the first panel. The fastener of the second panel and the fastener of the support panel are complementary strips of hook-and-loop material.

In the present invention, the support panel includes a first section which is hingedly connected to the first panel, a second section which is hingedly connected to the first section, and a third section that is hingedly connected to the second section opposite the first section. The third section has at least one fastener member affixed thereto. The second panel has a complementary fastener affixed to a surface thereof. The fastener member of the third section is engagable with the complementary fastener of the second panel.

The third section has at least one fastener member affixed thereto. The second panel has a strap member extending outwardly therefrom. The strap member has a complementary fastener thereon. The complementary fastener of the second panel is detachably engagable with the fastener member of the third section. The strap member extends over an edge of the first and second panel members opposite the hinged connection when engaged with the fastener member of the third section.

In the present invention, the first panel is actually a plurality of panels that are interposed in a generally stacked arrangement between the second panel and the support panel. Each of the plurality of panels is hingedly connected to each other. In the present invention, the hinge member is a strip of duct tape that is adhesively affixed to the edges of each of the panels.

A bingo sheet receiving means is affixed to the surface of the panels so as to retain a bingo sheet in flat surface-to-surface contact with the surface of the panels. This bingo sheet receiving means can includes a first elastic strap which extends longitudinally across a surface of the panel and a second elastic strap that extends transverse to the first elastic strap across the surface of the panel.

DETAILED DESCRIPTION OF THE INVENTION

Figure 1:
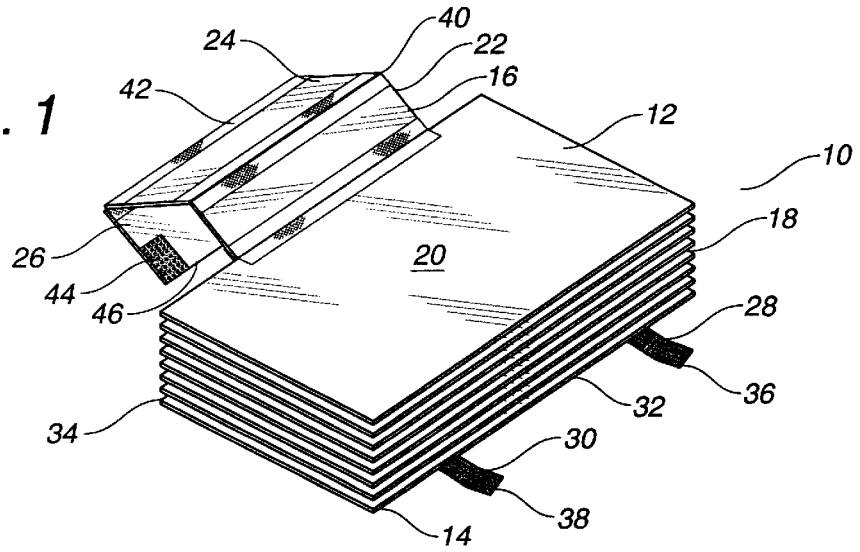
FIG. 1 is a perspective view of the apparatus of the present invention.

Referring to FIG. 1, there is shown at 10 the bingo sheet stacking apparatus in accordance with the teachings of the present invention. The bingo sheet stacking apparatus 10 includes a first panel 12, a second panel 14, and a multi-sectional support panel 16. The first panel 12 can include a plurality of panels that are arranged in a stacked arrangement 18 extending between the top panel 20 and the second panel 14. Each of the panels 18 is hingedly connected together. As such, the second panel 14 is hingedly interconnected to the first panel 12. The multi-sectional support panel 16 is hingedly connected to the first panel 12. The multi-sectional support panel 16 includes a first section 22, a second section 24 and a third section 26. The support panel 16 is configurable between a first planar configuration (illustrated in FIG. 2) and a second configuration of generally triangular cross-section (illustrated in FIGS. 5–8).

In FIG. 1, it can be seen that the first panel 12 is a generally flat planar panel of rectangular configuration. In the preferred embodiment of the present invention, the panel 12 can be a panel of acrylic plastic or plexiglass. Each of the panels 18 are preferably transparent. Each of the panels 18 (including the first panel 12) should have a size suitable for allowing a bingo sheet to be placed thereon. Each of the panels 18 is of a similar size and is arranged in a stacked configuration. It is important to note that at least one edge of the panels 18 is offset from a similar edge of an adjacent panel by a small distance. This facilitates the ability to flip from one panel to another throughout the stacked arrangement. In the preferred embodiment, this distance is at least 1/26 of an inch.

It can be seen that the second panel 14 is located at the bottom of the stacked configuration of panels 18. The second panel 14 has a first strap 28 and a second strap 30 extending outwardly therefrom beyond edge 32 of the second panel 14. The back edge 34 of the second panel 14 is hingedly connected to the panels 18 and hingedly interconnected to the first panel 12. As will be described hereinafter, the second panel 14 will include fastener members suitably located on the bottom surface of the panel 14 for the purpose of allowing the multi-sectional support panel 16 to be configured into its triangular configuration. The strap 28 includes a hook-and-loop material surface 36 thereon. Similarly, the strap 30 includes a hook-and-loop material strip 38 thereon. The hook-and-loop material strips 36 and 38 are suitable for being detachably affixed to complementary strips of hook-and-loop material located on the surface of the support panel 16.

The support panel 16 has a first section 22 which is hingedly connected at 40 to the second section 24. The second section 24 is hingedly connected at 42 to the third section 26. Each of the sections 22, 24 and 26 are planar members. The third section 26 includes a strip 44 of hook-and-loop material affixed adjacent to an edge 46 opposite the hinged connection of the third section 26 with the second section 24. Hook-and-loop material strip 44 can be suitably fastened to a complementary strip of hook-and-loop material on the bottom of the second panel 14 adjacent to the edge 34. Alternatively, the strip 44 can be detachably affixed to the strip of hook-and-loop material 38 found on strap 30.

Figure 2:
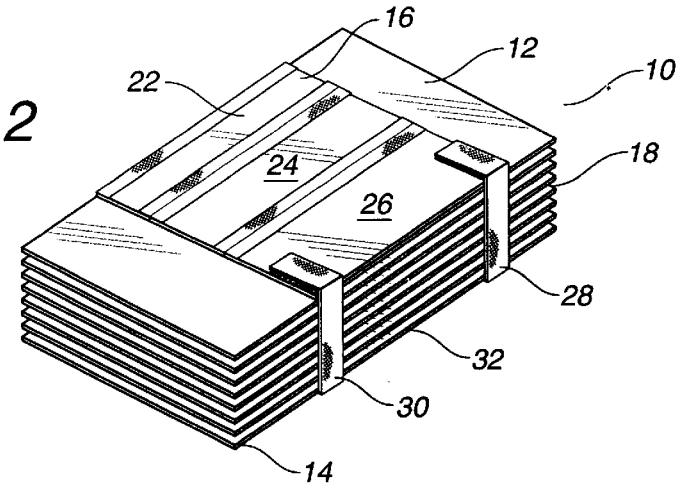
FIG. 2 is a perspective view of the apparatus showing the apparatus in its closed configuration.

FIG. 2 shows the apparatus 10 in its suitable condition for transportation and storage. It can be seen that the apparatus 10 has first panel 12 and second panel 14 with the plurality of panels 18 extending therebetween. The support panel 16 is arranged in its planar configuration. In this planar configuration, the first section 22, the second section 24 and the third section 26 are aligned in planar configuration and reside in surface-to-surface contact with the top surface of the first panel 12. The hook-and-loop material 38 on the second strap 30 engages the hook-and-loop material strip 44 on the third section 26. Similarly, the first strap 28 will engage a similar strip on the other side of the third section 26. It can be seen that the first strap 28 and the second strap 30 overlie the forward edges 32 of the panels 12, 14 and 18. As such, the panels are retained in a stacked configuration for transportation and storage.

Figure 3:
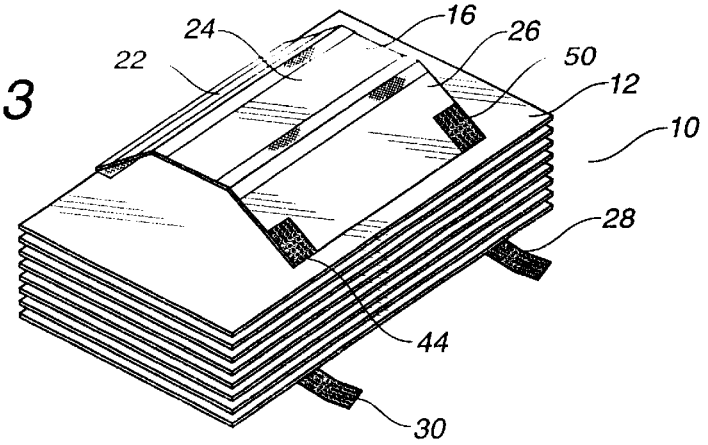
FIGS. 3 and 4 are perspective views showing the assembly of the apparatus of the present invention.
Figure 4:
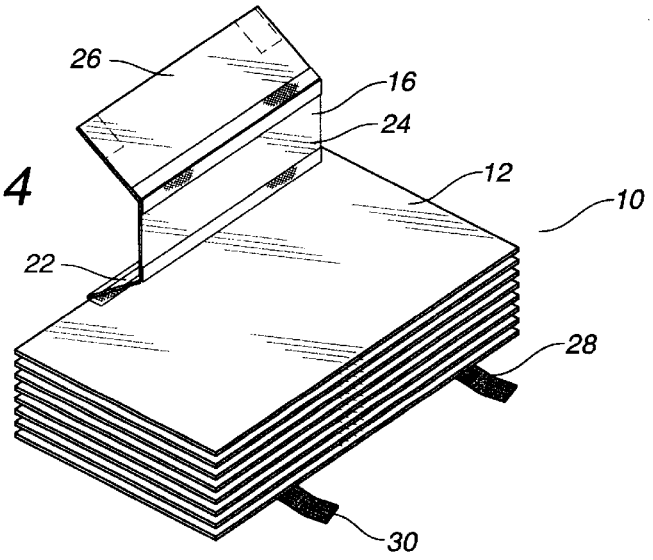

FIG. 3 shows the step that occurs when it is desired to assemble the apparatus 10 for usage and play. Initially, the first strap 28 is disengaged from the strip 50 of hook-and-loop material on the third section 26. The second strap 30 is disengaged from the strip of hook-and-loop material 44 found on the opposite side of the third section 26. As such, the support panel 16 is released from its secure position overlying the first panel 12. Each of the panels 24 and 22 are hingedly pivoted relative to one another. FIG. 4 shows how the support panel 16 is hingedly rotated for deployment of the panels.

Figure 5:
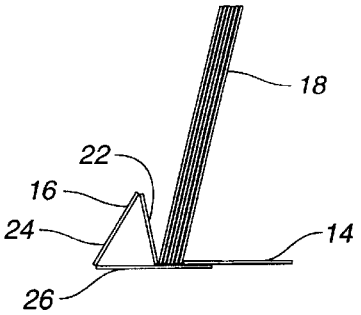
FIGS. 5–7 are side elevational views showing the operation of the apparatus of the present invention.

FIG. 5 illustrates how the support panel 26 is configured into its multi-sided geometrical configuration. In the preferred embodiment of the present invention, the multi-sided geometrical configuration has a triangular cross-section. In this arrangement, the strips 44 and 50 on the third section 26 engage complementary hook-and-loop material strips on the bottom surface of the panel 14. The second section 24 is folded at approximately a 60° angle with respect to the third section 26. Similarly, the first section 22 is folded at approximately a 30° angle with respect to the second section 24. The third section 26 resides flat and generally coplanar with the second panel 14. The panels 18 can then be pivotted about their hinge points so as to reside in juxtaposition with the second panel 14 or with the surface of the first section 22 of the support panel 16.

Figure 6:
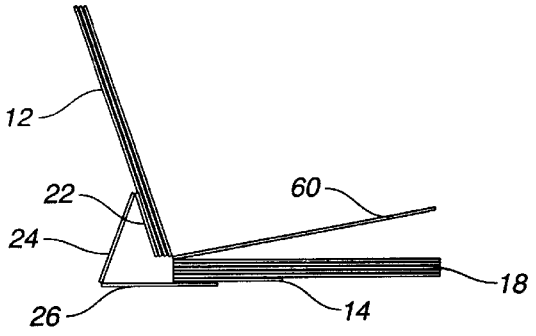

FIG. 6 shows that the first panel 12 is residing in juxtaposition against the surface of the first section 22 of the support panel 16. The remaining panels 18 reside against the second panel 14. A panel 60 is shown as lifted so as to expose a bingo sheet residing on the faces of each of the panels.

Figure 7:
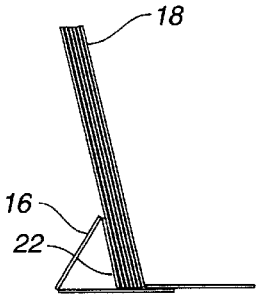

FIG. 7 shows the panels 18 as lifted and residing against the surface of the first section 22 of the support panel 16. By lifting each of the panels one-at-a-time, the bingo sheet on the surface of each of the panels is easily displayed for scanning and marking.

Figure 8:
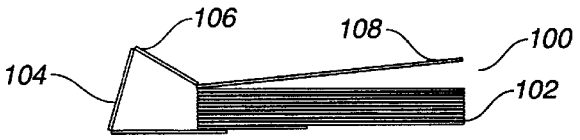
FIG. 8 is a side elevational view showing the adaptability of the present invention for receiving a large number of panels.

FIG. 8 shows an alternative embodiment 100 of the present invention in which a larger number of panels 102 are utilized. It can be seen that the support panel 104 has a somewhat skewed triangular configuration. However, the first section 106 of the support panel 104 is in a proper location for supporting a panel 108 thereon.

Figure 9:
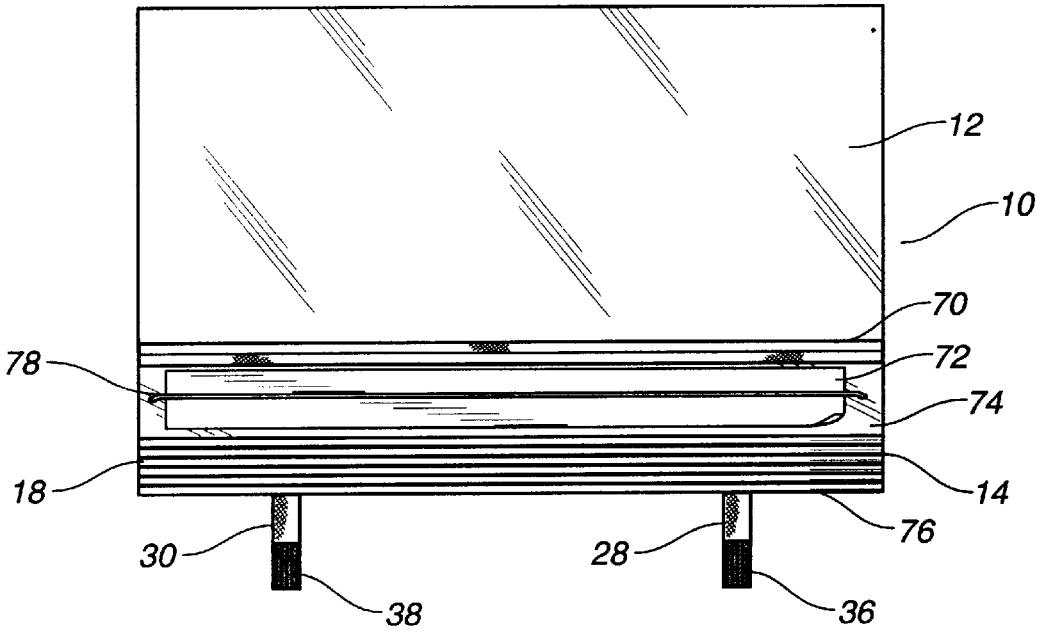
FIG. 9 is a frontal view showing the apparatus of the present invention in its position for viewing.

FIG. 9 illustrates the apparatus 10 of the present invention in a suitable condition for use and play. It can be seen that the first panel 12 has been pivotted about hinge point 70 so as to extend bingo sheet 72 residing on panel 74. It can further be seen that straps 28 and 30 extend outwardly from a forward edge 76 of the second panel 14. A plurality of panels 18 reside between the display panel 74 and the second panel 14. The first panel 12 is residing against the support surface of the third section 22 of the support panel 16. The bingo sheet 72 is retained in position on the surface of the display panel 74 by an elastic strap 78. Elastic strap 78 extends longitudinally across the surface of the display panel 74. The elastic strap 78 can extend through holes formed in the panel 74 or it can extend around the entire panel 74. This elastic strap 78 can be formed from polyester elastic braid and the ends overlapped and glued. Alternatively, rubber bands, and similar items, can be used for the bingo sheet receiving means of the present invention. The elastic strap 78 should be suitable for retaining the bingo sheet 72 in flat surface-to-surface contact with the surface of the display panel 74.

FIG. 9 shows, in particular, the hinged connection between the first panel 12 and the display panel 74. In the present invention, the hinged connection is duct tape. The duct tape is adhesively secured to the surfaces adjacent to the bottom edge of panel 12 and is secured to the edge of the display panel 74. The duct tape which forms the hinge mechanism of the present invention is similarly applied to the other panels 18.

In FIG. 9, it can be seen that the hook-and-loop material 36 is formed on the strap 28. Also, the hook-and-loop material 38 is formed on the strip 30. This VELCRO (TM) material will face the user when the apparatus 10 is in use.

Figure 10:
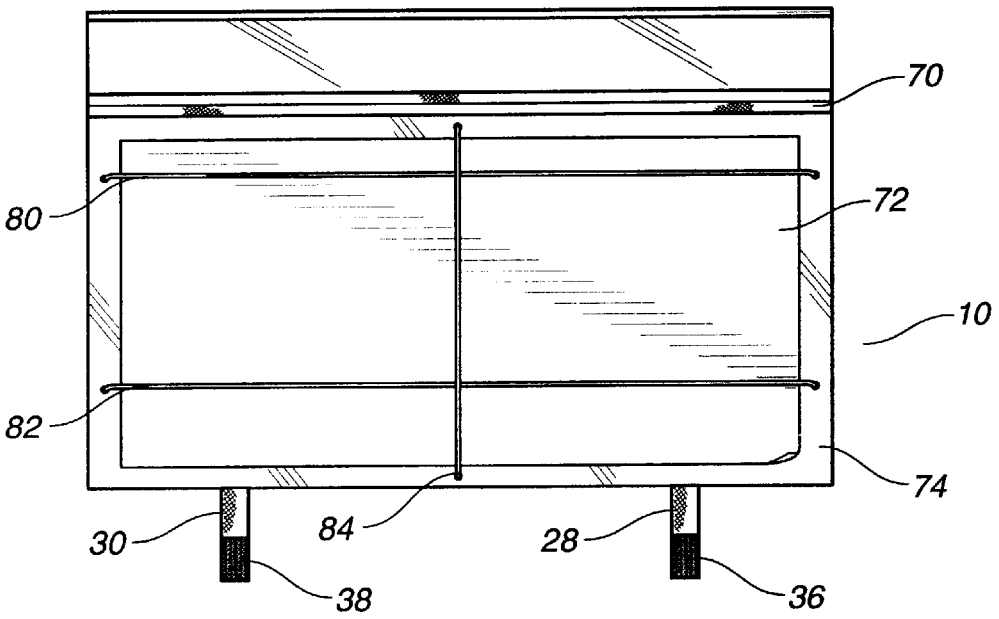
FIG. 10 is a plan view of the apparatus of the present invention showing the apparatus in its position for viewing.

FIG. 10 shows the plan view of the apparatus 10. As can be seen, the bingo sheet 72 is secured to the surface of the panel 74. The bingo sheet 72, as illustrated, includes a large number of bingo cards. The embodiment shown in FIG. 10 illustrates a first elastic strap 80 extending generally longitudinally across a surface of the panel 74. Another elastic strap 82 extends longitudinally across the surface of the panel 74 in generally parallel relationship to the strap 80. Transverse strap 84 extends transverse to the orientation of straps 80 and 82. Each of these straps serves to maintain the bingo sheet 72 in its flat surface-to-surface contact with the top surface of the panel 74.

Figure 11:
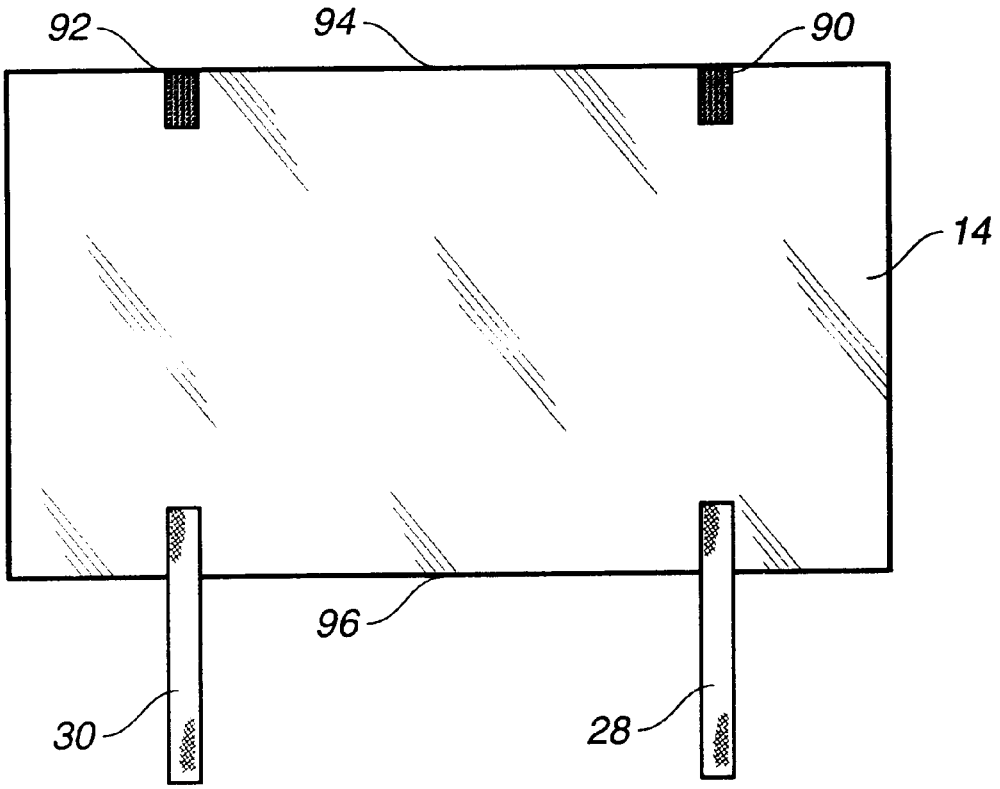
FIG. 11 is a bottom view of the apparatus of the present invention.

FIG. 11 shows the underside of the panel 14. It can be seen that panel 14 has a strip 90 of hook-and-loop material and a strip 92 of hook-and-loop material located adjacent to the edge 94 of the panel 14. These strips 90 and 92 serve to receive complementary hook-and-loop material strips on the third section of the support panel 16. The strips 90 and 92 will engage the strips on the third section 26 of the support panel 16 when the support panel is arranged in its multi-sided geometrical configuration. Straps 28 and 30 extend outwardly from the forward edge 96 of panel 14. Straps 28 and 30 will engage the strips of hook-and-loop material on the third section 26 of the support panel 16 when the support panel 16 is positioned in planar orientation for transportation and storage.

Figure 12:
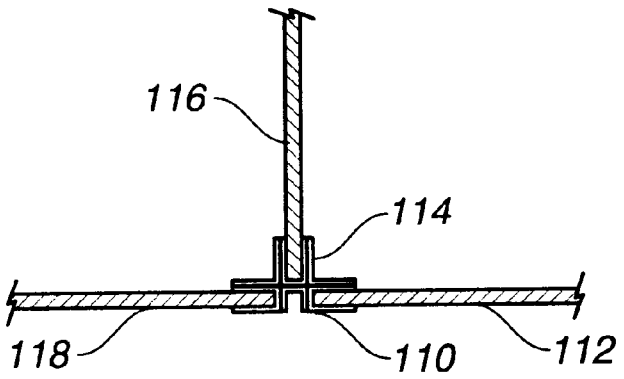
FIG. 12 is an isolated view showing the hinged connection of the panels relative to one another.

FIG. 12 illustrates how the hinged connection of the panels of the present invention is arranged. It can be seen that duct tape 110 is initially adhered to a panel 112 and wrapped around the edge 114 of the panel. The duct tape 110 is then adhered to the edge of another panel 116. This duct tape is then extended so as to be adhered to the edge of another panel 118. Each of the panels is joined together in this manner. Experimentation of the present invention has indicated that the duct tape 110 will effectively adhere each of the panels 112, 116 and 118 together for an extended period of time.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A bingo sheet stacking apparatus comprising:

a first panel;

a second panel hingedly connected to said first panel; and a support panel hingedly connected to said first panel, said support panel configurable between a first planar configuration and a second configuration of a generally triangular cross-section, said second panel having a fastener member affixed to a surface thereof opposite said first panel, said support panel having a fastener attached thereto, said fastener of said second panel engagable with said fastener of said support panel so as to retain said support panel in said second configuration.

2. The apparatus of claim 1, said fastener of said second panel positioned adjacent an area in which said second panel is hingedly connected with said first panel, said fastener of said support panel positioned at an end of said support panel opposite the hinged connection with said first panel.

3. The apparatus of claim 2, said fastener of said second panel and said fastener of said support panel being complementary strips of hook-and-loop material.

4. The apparatus of claim 1, said first panel comprising:

a plurality of panels interposed in a generally stacked arrangement between said second panel and said support panel, each of said plurality of panels has an edge which is offset by no less than 1/16" from a common edge of an adjacent panel.

5. The apparatus of claim 4, each of said plurality of panels being hingedly connected to each other.

6. The apparatus of claim 1, said first panel having a hinge member attached to an edge of said first panel, said hinge member being a strip of duct tape adhesively affixed to said edge of said first panel, said strip of duct tape being adhesively attached to an adjacent panel.

7. The apparatus of claim 1, further comprising:

bingo sheet receiving means affixed to a surface of said first panel, said bingo sheet receiving means for retaining a bingo sheet in flat surface-to-surface contact with said surface of said first panel.

8. The apparatus of claim 7, said bingo sheet receiving means comprising:

a first elastic strap extending longitudinally across said surface of said first panel.

9. The apparatus of claim 8, said bingo sheet receiving means further comprising:

a second elastic strap extending across said surface of said first panel in transverse relation to said first elastic strap.

10. A bingo sheet stacking apparatus comprising:

a first panel;

a second panel hingedly connected to said first panel; and a support panel hingedly connected to said first panel, said support panel configurable between a first planar configuration and a second configuration of a generally triangular cross-section, said support panel comprising:

a first section hingedly connected to said first panel;

a second section hingedly connected to said first section; and a third section hingedly connected to said second section opposite said first section.

11. The apparatus of claim 10, said third section having at least one fastener member affixed thereto, said second panel having a complementary fastener affixed to a surface thereof, said fastener member of said third section engagable with said complementary fastener of said second panel.

12. The apparatus of claim 10, said third section having at least one fastener member affixed thereto, said second panel having a strap member extending outwardly therefrom, said strap member having a complementary fastener thereon, said complementary fastener of said second panel detachably engagable with said fastener member of said third section.

13. The apparatus of claim 12, said strap member extending over an edge of said first and second panels opposite an area in which said second panel is hingedly connected to said first panel when engaged with said fastener member of said third section.

14. The apparatus of claim 12, said fastener member of said third section being a strip of hook-and-loop material, said complementary fastener of said strap member being a strip of hook-and-loop material complementary to said strip of hook-and-loop material of said third section.

15. A bingo sheet stacking apparatus comprising:

a first panel;

a second panel underlying said first panel, said second panel having a fastener member affixed to a surface thereof opposite said first panel; and a support panel hingedly connected to said first panel, said support panel having a fastener member affixed thereto with an end opposite the hinged connection with said first panel, said support panel being foldable into a multi-sided geometrical configuration, said fastener member of said second panel detachably engagable with said fastener member of said support panel when in the multi-sided geometrical configuration, said support panel comprising:

a first section hingedly connected to said first panel;

a second section hiniedly connected to said first section; and a third section hingedly connected to said second section opposite said first section, said geometrical configuration having a generally triangular cross-section.

16. The apparatus of claim 15, said first panel comprising:

a plurality of flat panels hingedly connected to each other, said plurality of flat panels being interposed between said support panel and said second panel, said plurality of flat panels arranged in a stacked configuration, each of said plurality of panels having an edge which is offset by no less than 1/16" from a common edge of an adjacent panel.

17. The apparatus of claim 15, said third section having at least one fastener member affixed thereto, said second panel having a complementary fastener member affixed to a surface thereof, said fastener member of said third section engagable with said complementary fastener of said second panel.

18. The apparatus of claim 15, said third section having at least one fastener member affixed thereto, said second panel having a strap member extending outwardly therefrom, said strap member having a complementary fastener thereon, said complementary fastener of said second panel detachably engagable with said fastener member of said third section.

* * * * *